US005824192A

United States Patent [19]

Radu

[11] Patent Number: 5,824,192

[45] Date of Patent: Oct. 20, 1998

[54] METHOD AND ADJUVANT COMPOSITION TO IMPROVE RETENTION OF PARTICLES ON A WIRE SCREEN

[75] Inventor: Georges Radu, Brossard, Canada

[73] Assignee: E. QU. I. P. International Inc., Quebec, Canada

[21] Appl. No.: 653,646

[22] Filed: May 24, 1996

[51] Int. Cl.[6] ..... D21H 21/10

[52] U.S. Cl. ..... 162/158; 162/164.1; 162/164.3; 162/164.5; 162/165; 162/166; 162/167; 162/168.1; 162/183

[58] Field of Search ..... 162/164.1, 165, 162/166, 167, 164.3, 168.1, 164.5, 158, 183

[56] References Cited

U.S. PATENT DOCUMENTS 5,538,596 7/1996 Satterfield et al. ..... 162/164.1

5,554,260 9/1996 Radu et al. ..... 162/164.3

*Primary Examiner*—Peter Chin

[57] ABSTRACT

Disclosed is a method for the production of paper and an adjuvant composition comprising the following ingredients: 30 to 80% by weight of phenolic resin or modified phenolic resin; 10 to 50% by weight of melamine resin; and 5 to 35% by weight of at least one naphthalene sulphonate salt. The ingredients are under granulated form or dissolved in an aqueous solution. The method comprises the step of admixing the adjuvant composition with a solution of one or several polyethylene oxide having a molecular weight varying from $1\times10^6$ to $13\times10^6$ and with an aqueous mixture comprising lignocellulosic particles and an aqueous medium to significantly improve the retention of particles such as fines and fibers, on a wire screen and the drainage of the aqueous medium.

16 Claims, No Drawings

METHOD AND ADJUVANT COMPOSITION TO IMPROVE RETENTION OF PARTICLES ON A WIRE SCREEN

The present invention relates to a method for the production of paper and to an adjuvant composition which significantly improves the retention of particles such as fines and fibers, on a wire screen and the drainage of the aqueous medium.

Advantageously, a particles retention, especially a retention of fines and fibers can be achieved for kraft, sulphite (high yield and low yield), bisulphite, mechanical, OPCO, BTCMP, TCMP, BCMP, hard wood, such as oak, birch, maple, elm, wild-cherry, soft woods such as conifer trees, and TMP pulps and any mix in any proportion of two or more types of pulp.

Applications may be the followings:

- any washer, thickener, save-all, disc filter or drum filter in any pulp making process;
- any pulp machine, board machine or paper machine in the production sector;
- any clarifier or flotation or fiber separation unit in the effluent treatment process, including krofta, posseidon, sedimentation clarifier, but not limited to these;
- any equipment used in the de-inking process, included or not above.

The Applicant already disclosed in International Patent Application publised under no. WO 94/11575 on May 26, 1994 to use a mixture of one or more polyethylene oxides with naphthalene sulphonate salts, as an adjuvant, to improve the retention of fines and fibers on a wire screen from a mixture comprising lignocellulosic fines and fibers and an aqueous medium, and thereby to improve the drainage of the aqueous medium.

The Applicant has now improved the method disclosed in PCT application number WO 94/11575 to reduce the amount of naphthalene sulphonate salts used in the production of paper.

The Applicant found has a new and improved method involving a combined use of an new adjuvant composition with a solution of one or several polyethylene oxide having a molecular weight varying from $1\times10^6$ to $13\times10^6$, in a mixture of lignocellulosic particles and an aqueous medium, which allows to further improve the retention of the particles on a wire screen and the drainage of the aqueous medium.

More particularly, the invention relates to an improvement in a method for the production of paper and analogous products. This improvement is characterized by the fact that a retention and drainage aid composition hereinafter called adjuvant composition comprising following ingredients:

30 to 80% by weight of phenolic resin or modified phenolic resin;

10 to 50% by weight of melamine resin; and 5 to 35% by weight of at least one naphthalene sulphonate salt, and a solution of one or several polyethylene oxide having a molecular weight varying from $1\times10^6$ to $13\times10^6$, are admixed with an aqueous mixture comprising lignocellulosic particles, such as fibers and fines, and an aqueous medium. The ingredients of the adjuvant composition are either under granulated form or dissolved in an aqueous solution. The polyethylene oxide is admixed with the aqueous mixture when this latter already contains at least a part of the adjuvant composition.

The invention also relates to the adjuvant composition as defined above and to the use of said composition to improve the drainage.

Preferably, the adjuvant composition comprises modified phenolic resin instead of phenolic resin. A modified phenolic resin is preferred to a non-modified phenolic resin since it is of lower lowered toxicity. Furthermore, the modified phenolic resin has a longer shelf life varying around 18–24 months instead of a few months for the non-modified phenolic resin. Among the modified phenolic resin suitable for embodying the adjuvant composition of the present invention, products sold under the commercial names CASTOPHEN PR-511, Liquid TRICORESERVE NSB, INTERATEX N-8 150%, CENEKOL 1141, CENEGEN B conc, CENEKOL FT Supra, CENEGEN and CENEKON NCS Liquid are preferred.

Advantageously, the adjuvant composition further comprises up to 10% by weight of at least one alkoxylated alkyl phenol, and preferably an ethoxylated nonyl phenol.

Preferably, the adjuvant composition is in association with an aqueous excipient and the polyethylene oxide is in association with an aqueous excipient, both aqueous excipients being the same or different. Both associations may be admixed with a mixture comprising lignocellulosic fines and fibers to thus define either a pulpable pulp or an aqueous suspension.

Advantageously, the adjuvant composition comprising the naphthalene sulphonate salt(s), especially sodium naphthalene sulphonate salt, is uniformly dispersed in the mixture before introducing one or several polyethylene oxide. Preferably, the adjuvant composition should be applied at least 30 seconds before it gets in contact with the polyethylene oxide to thus give enough time to the salts of the adjuvant composition to condition the particles, such as fines and fibers.

Advantageously, the aqueous suspension is either of the type intended to be laid on a wire screen of a paper machine to form a sheet of paper or of a pulp machine, or of the type defining a white water collected in a wire pit of a paper machine of a pulp machine. This white water may be partially or totally recycled as an effluent of a step for preparing a pulpable pulp comprising lignocellulosic fines and fibers and an aqueous medium, or passed at least in part with other waste water through a clarifier. This white water charged with the adjuvant composition and polyethylene oxide contributes to make the clarifier more efficient.

Preferably, in a pulp and paper plant, the admixture of the adjuvant composition with the mixture of lignocellulosic fines and fibers and aqueous medium may be applied anywhere in the system and advantageously not between fan pumps and a head box. It may be applied in the white water system (wire pit), mixing tank, in the preparation of clay system or any tank that could be in contact with fiber giving on the machine. Preferably, the admixture of the adjuvant composition with the mixture of lignocellulosic fines and fibers and aqueous medium is applied in the mixed pulp tank. The polyethylene oxide solution may be applied preferably between the fan pumps and the head box, but it is also possible to apply it before the fan pumps and remain efficient, like between the mix tank and the fan pumps.

In use, the aqueous suspension is laid on a wire screen of a paper machine to form a sheet of paper fed in pulp machine type. The water collected in the wire pit of the paper machine or of the pulp machine and essentially consisting of a part of the aqueous suspension not retained on the wire screen and still containing the ingredients of the adjuvant composition and polyethylene oxide, is recycled for preparing either a pumpable pulp or a fresh aqueous suspension intended to be laid on the wire screen, being understood that the recycled white water contributes for a part to the admixture of the adjuvant composition and polyethylene oxide with the aqueous suspension.

Preferably, an equilibrium is set between the amount of the ingredients of the adjuvant composition and polyethylene oxide retained on the wire screen and the amount of the ingredients of the adjuvant composition and polyethylene oxide collected in the white water in the wire pit and recycled to the preparation of either a pumpable pulp or a fresh aqueous suspension intended to be laid on the wire screen, to thus allow to admix to the pulp or fresh aqueous suspension intended to be laid on the wire screen, only the amount of the ingredients of the adjuvant composition and polyethylene oxide retained in the sheet of paper or in the pulp.

Advantageously, the naphthalene sulphonate salt(s) comprised in the adjuvant composition are selected from the group consisting of sodium, potassium, ammonium, calcium and aluminium salt(s).

Advantageously also, the polyethylene oxide has a molecular weight varying from $4,5\times10^6$ to $12\times10^6$.

At least one enhancer may further be admixed to the mixture. This at least one enhancer is selected from the group consisting of polyaluminium sulphate, polyaluminium silicate sulphate, sodium aluminate, polyaluminium chloride, magnesium hydroxide and bentonite.

Advantageously, the polyethylene oxide may be admixed with the aqueous mixture of lignocellulosic particles, such as fines and fibers, to represent from 10 to 1500 grams per ton of dry matter of the mixture, preferably from 30 to 600 grams per ton of dry matter of the mixture.

Advantageously also, the ingredients of the adjuvant composition may be admixed with the aqueous mixture of lignocellulosic particles, such as fines and fibers, to represent from 50 to 1500 grams per ton of dry matter of the mixture, preferably from 50 to 500 grams per ton of dry matter of the mixture.

EXAMPLE

A BRITT GAR test, well known in the industry, was performed on the three different compositions to test their efficiency to improve the retention of particles on the wire screen and the drainage of the aqueous medium.

The first composition, referred to as INTERAC 1323, comprised the adjuvant of the present invention. More precisely, the adjuvant composition comprised:

- 50% of phenolformaldehyde resin (sold under the trade name of CASCOPHEN PR-511 by BORDEN);
- 30% of sulfonated melamine formaldehyde resin (sold under the trade name of MELADYNE by HANDY CHEMICALS); and
- 20% sodium naphthalene sulphonate (sold by HANDY CHEMICALS).

The second composition, referred to as INTERAC 1169, was the composition of the closest prior art, viz. the composition of the Applicant's own PCT application published May 26, 1994 under the publication number WO 94/11575. More particularly, INTERAC 1169 comprises 100% of sodium naphthalene sulphonate (sold by HANDY CHEMICALS).

The third composition comprised 100% of phenolformaldehyde resin (sold under the trade name of CASCOPHEN PR-511 by BORDEN).

To each composition, 60 grams per ton of dry matter of a mix polyethylene oxide having a mean molecular weight ranging between 7 to $8\times10^6$ was added.

Finally, to each composition, an aqueous mixture of lignocellulosic particles was admixed in such an amount that each composition represent either 564, 1128 or 1692 grams per ton of dry matter of the mixture.

The resulting compositions were alternatively tested. For each composition, the percentages of the First Pass Retention (%FPR), the First Pass Ash Retention (%FPAR) and the drainage in milliliter of said composition has been mesured. The results concerning INTERAC 1323, INTERAC 1169 and the third composition are reported in table 1, 2 and 3 respectively.

TABLE 1 results of tests performed on INTERAC 1323

| Dosage g/T | First pass retention FPR % | First pass ash retention FPAR % | Drainage (ml) |
|---|---|---|---|
| 564 | 67.9 | 53.7 | 194 |
| 1128 | 71.4 | 61.3 | 198 |
| 1692 | 76.1 | 63.7 | 206 |

TABLE 2 results of tests performed on INTERAC 1169

| Dosage g/T | First pass retention FPR % | First pass ash retention FPAR % | Drainage (ml) |
|---|---|---|---|
| 564 | 32.8 | 31.1 | 190 |
| 1128 | 39.7 | 33.4 | 194 |
| 1692 | 41.2 | 37.9 | 192 |

TABLE 3 results of tests performed on the third composition

| Dosage g/T | First pass retention FPR % | First pass ash retention FPAR % | Drainage (ml) |
|---|---|---|---|
| 564 | 53.7 | 40.6 | 196.0 |
| 1128 | 62.0 | 48.1 | 193.5 |
| 1692 | 63.9 | 55.9 | 186.9 |

Generally, the higher the values of %FPR and %FPAR are, the more fibers are retained on the wire screen and the more efficient is the composition. Furthermore, more the %FPR and the %FPAR values are and lesser the drainage values tends to be. However, higher is the drainage and shorter is the drying of the paper and the best dynamic properties the paper has. Consequently, one must find an optimal dosage range to obtain the best possible %FPR and still achieving a good drainage.

The values of the tables 1, 2 and 3 have been normalized with a control to be suitable for comparison to each other. The control comprises lignocellulosic fibers only. The results obtained for the calibration with the control are listed in table 4.

TABLE 4 results of the calibration with the control

| Dosage g/T | First pass retention FPR % | First pass ash retention FPAR % | Drainage (ml) |
|---|---|---|---|
| 0 | 30.1 | 29.2 | 187 |

According the results listed in the tables 1 to 4, it is possible to deduce the relative improvment of each composition by dividing the results of each composition by the results of the control. These results showing the relative improvment are listed in table 5.

TABLE 5 relative improvment of the three different compositions

| composition | Dosage g/T | First pass retention FPR % (%) | First pass ash retention FPAR % (%) | Drainage (%) |
|---|---|---|---|---|
| INTERAC 1323 | 564 | 125.6 | 83.9 | 3.7 |
| | 1128 | 137.2 | 109.9 | 5.9 |
| | 1692 | 152.8 | 118.2 | 10.2 |
| INTERAC 1169 | 564 | 9.0 | 6.5 | 1.6 |
| | 1128 | 31.9 | 14.4 | 3.7 |
| | 1692 | 36.9 | 29.8 | 2.7 |
| third | 564 | 78.4 | 39.0 | 4.8 |
| composition | 1128 | 106. | 64.7 | 3.5 |
| | 1692 | 112.3 | 91.4 | 0.0 |

As apparent from table 5, INTERAC 1323, which is the adjuvant of the present invention, is significantly better than INTERAC 1169 or the third composition. The increase in the %FPR is higher for INTERAC 1323 than for any other composition. Furthermore, the superiority of INTERAC 1323 is clearly marked by the increase of the %FPAR. Finally, the improvement in the drainage is as good or even better than the third composition or INTERAC 1169.

In fact, according to table 5, the third composition seems better than INTERAC 1169, but not as good as INTERAC 1323. However, the third composition consisting of phenolic resin only would be to expensive to used. The composition has been illustrated herein for the comparison purpose only since, in the industry, this composition is not often used because it would be too expensive to use it.

Accordingly, the present invention provides an adjuvant composition that is better and cheaper to produce and to use and comprising less hazardous compound such as the phenolic resin which is toxic, than the other composition.

Although preferred embodiments of the invention has been described in detail in the specification and in the example, it is to be understood that the invention is not limited to these precise embodiments and that many changes and modifications may be effected therein without departing from the scope or spirit of the invention.

What is claimed is:

1. In a method for the production of paper comprising the step of laying an aqueous mixture comprising lignocellulosic fibers and fines and an aqueous medium on a wire screen of a paper machine to form a sheet of paper, the improvement wherein:

medium on a wire screen of a paper machine to form a sheet of paper, the improvement wherein:

a retention and drainage aid composition comprising:

30 to 80% by weight of a phenolic resin or a modified phenolic resin, 10 to 50% by weight of a sulfonated melamine formaldehyde resin, and 5 to 35% by weight of at least one naphthalene sulphonate salt selected from the group consisting of naphthalene sulphonate sodium, potassium, ammonium, calcium, aluminum and mixtures thereof;

said ingredients being either under a granulated form or dissolved in an aqueous solution;

and a solution of at least one polyethylene oxide having a molecular weight varying from $1\times10^6$ to $13\times10^6$;

are admixed with said aqueous mixture in such amounts that from 50 to 1500 grams of said retention and drainage aid and from 10 to 1500 grams of said at least one polyethylene oxide are present per ton of dry matter in said aqueous mixture;

said at least one polyethylene oxide being admixed with said aqueous mixture when the latter already contains at least a part of said retention and drainage aid composition.

2. In a method for the production of paper comprising the step of laying an aqueous mixture comprising lignocellulosic fibers and fines and an aqueous medium on a wire screen of a paper machine to form a sheet of paper, the improvement wherein:

a retention and drainage aid composition comprising:

30 to 80% be weight of a modified phenolic resin, 10 to 50% by weight of sulfonated melamine formaldehyde resin, and 5 to 35% by weight of at least one naphthalene sulphonate salt selected from the group consisting of naphthalene sulphonate sodium, potassium, ammonium, calcium, aluminum and mixtures thereof;

said ingredients being either under a granulated form or dissolved in an aqueous solution;

and a solution of at least one polyethylene oxide having a molecular weight varying from $1\times10^6$ to $13\times10^6$;

are admixed with said aqueous mixture in such amounts that from 50 to 1500 grams of said retention and drainage and from 10 to 1500 grams of said at least one polyethylene oxide are present per ton of dry matter in said aqueous mixture, said at least one polyethylene oxide being admixed with said aqueous mixture when the latter already contains at least a part of said retention and drainage aid composition.

3. A method according to claim 1, wherein the retention and drainage aid composition further comprises up to 10% by weight of at least one alkoxylated alkyl phenol.

4. A method according to claim 2, wherein the retention and drainage aid composition further comprises up to 10% by weight of at least one alkoxylated alkyl phenol.

5. A method according to claim 3, wherein said at least one alkoxylated all phenol is ethoxylated nonyl phenol.

6. A method according to claim 4, wherein said at least one alkoxylated alkyl phenol is ethoxylated nonyl phenol.

7. A method according to claim 2, wherein said retention and drainage aid composition is in association with an aqueous excipient, the polyethylene oxide is in association with an aqueous excipient, and both of said associations are admixed with said aqueous mixture comprising lignocellulosic fines and fibers to thus define a pumpable pulp.

8. A method according to claim 2, wherein said retention and drainage aid composition is in association with an aqueous excipient, the polyethylene oxide is in association with an aqueous excipient, and both of said associations are admixed with said aqueous mixture comprising lignocellulosic fines and fibers to thus define an aqueous suspension.

9. A method according to claim 8, wherein said aqueous suspension forms an effluent consisting of waste water comprising white water that is collected in a wire pit of said paper machine or of a pulp machine, and wherein said effluent is passed through a clarifier.

10. A method according to claim 8, wherein said aqueous suspension forms a white water that is collected in a wire pit of said paper machine or of a pulp machine, and wherein said white water is recycled at least in part as an effluent for preparing a pumpable pulp comprising lignocellulosic fines and fibers and an aqueous medium.

11. A method according to claim 8, comprising the additional step of collecting a white water in a wire pit of the paper machine, said white water essentially consisting of part of said aqueous suspension not retained on the wire screen and still containing the ingredients of the retention and drainage and composition and the polyethylene oxide, and recycling said white water for preparing either a pumpable pulp or a fresh aqueous suspension intended to be laid on said wire screen, whereby said recycled white water contributes for a part to the admixture of the retention and drainage aid composition and polyethylene oxide with the aqueous suspension.

12. A method according to claim 11, wherein an equilibrium is set between the amount of the ingredients of the retention and drainage aid composition and polyethylene oxide retained on the wire screen and the amount of the ingredients of the retention and drainage aid composition and polyethylene oxide collected in the white water in the wire pit and recycled to the preparation of either a pumpable pulp or a fresh aqueous suspension, in order to admix to said pulp or fresh aqueous suspension only the amount of the ingredients of the retention and drainage aid composition and polyethylene oxide that was retained in the sheet of paper or in the pulp.

13. A method according to claim 2, wherein said at least one polyethylene oxide has a molecular weight ranging from $4.5\times10^6$ to $12\times10^6$.

14. A method according to claim 13, wherein at least one enhancer is further admixed to said aqueous mixture, said at least one enhancer being selected from the group consisting of a polyaluminum sulphate, polyaluminum silicate sulphate, sodium aluminate, polyaluminum chloride, magnesium hydroxide and bentonite.

15. A method according to claim 13, wherein said polyethylene oxide is admixed with said aqueous mixture so as to represent from 30 to 600 grams per ton of dry matter of said mixture.

16. A method according to claim 15, wherein the ingredients of retention and drainage aid composition are admixed with the aqueous mixture to represent an amount 50 to 500 grams per ton of dry matter of said mixture.

* * * * *

UNITED STATES PATENT AND TRADEMARK OFFICE

CERTIFICATE OF CORRECTION

PATENT NO. : 5,824,192

DATED : October 20, 1998

INVENTOR(S) : Georges Radu

It is certified that error appears in the above-identified patent and that said Letters Patent is hereby corrected as shown below:

Column 6, line 55, delete "all", insert --alkyl--.

Signed and Sealed this

Twenty-third Day of March, 1999

*Attest:*

*Attesting Officer*

Q. TODD DICKINSON

*Acting Commissioner of Patents and Trademarks*